United States Patent [19]

Takayanagi

[11] Patent Number: 4,664,172

[45] Date of Patent: May 12, 1987

[54] METHOD FOR PRODUCTION OF INVESTMENT SHELL MOLD FOR GRAIN-ORIENTED CASTING OF SUPER ALLOY

[75] Inventor: Takeshi Takayanagi, Aichi, Japan

[73] Assignees: Agency of Industrial Science and Technology; Ministry of International Trade and Industry, both of Tokyo, Japan

[21] Appl. No.: 761,697

[22] Filed: Aug. 2, 1985

[30] Foreign Application Priority Data

Aug. 9, 1984 [JP] Japan ..... 59-167224

[51] Int. Cl.[4] ..... B22C 1/02

[52] U.S. Cl. ..... 164/34; 164/122.1; 164/361; 164/519; 164/528; 106/38.9; 106/38.27

[58] Field of Search ..... 164/519, 34–36, 164/122.1, 122.2, 361, 528; 106/38.3, 38.27, 38.9

[56] References Cited

U.S. PATENT DOCUMENTS 4,026,344 5/1977 Greskovich ..... 164/519

*Primary Examiner*—Kuang Y. Lin

*Attorney, Agent, or Firm*—Oblon, Fisher, Spivak, McClelland & Maier

[57] ABSTRACT

An investment shell mold of a texture having a stucco material dispersed in mullite useful for grain-oriented casting of a Ni-base super alloy is produced by preparing a slurry having alumina powder or a mixture of alumina powder with at least one ceramic powder selected from among zircon powder, mullite powder, and spinel powder blended with a silicate binder such as silica sol, applying the slurry to the surface of an expendable pattern made typically of wax for the production of the mold, then applying thereon a stucco material, thereafter repetitively applying substantially equal slurry and stucco material alternately thereon until the applied layers assume a prescribed thickness, allowing the applied layers to solidify, then heating the hardened layers to a temperature exceeding 1,400° C. thereby enabling $SiO_2$ produced from the binder and the alumina powder in the slurry to react with each other and produce mullite.

2 Claims, 7 Drawing Figures

METHOD FOR PRODUCTION OF INVESTMENT SHELL MOLD FOR GRAIN-ORIENTED CASTING OF SUPER ALLOY

BACKGROUND OF THE INVENTION

This invention relates to a method for the production of an investment shell mold to be used in producing by grain-oriented casting a Ni-base super alloy suitable for fabrication of a precision cast article.

Heretofore, investment shell molds for casting an alloy containing only a small amount of active elements such as Al or Ti have been produced by repeatedly applying on a mold-producing pattern alternate layers of a slurry having zircon or fused silica flour blended in a silicate binder and layers of grains of zircon, fused silica, molochite, or mullite and subsequently firing the applied layers of the aforementioned slurry and grains at 800° to 1,000° C. The mold produced by this method, however, has free silica on the cavity surface thereof. When this mold is used in producing a grain-oriented super alloy having a high Al or Ti content, since the molten alloy and the mold are held in contact with each other for a long time during the grain-oriented solidification at elevated temperatures, the free silica on the cavity surface of the mold is reduced to Si by Al or Ti and passes into the molten alloy, with the result that the silicon degrades the mechanical properties of the cast article at elevated temperatures. The mold itself possesses a poor high-temperature strength of not more than 20 kgf/cm$^2$ at 1,400° C. and tends to deform and, therefore, cannot be effectively used in such a casting as a grain-oriented casting which keeps the mold in contact with the molten alloy of highly elevated temperature for a long time.

Formerly, a group of inventors including the present inventor perfected a method for the production of an investment shell mold free from the drawback described above and, therefore, suitable for the fabrication of a grain-orientedly solidified super alloy. This invention was filed under U.S. patent application Ser. No. 625,895.

This method is characterized by the steps of preparing a slurry by dispersing powdered oxide of at least one element selected from the group consisting of magnesium, aluminum, zirconium, hafnium, yttrium, calcium, lanthanum, cesium, barium, and silicon in a solution of an organic soluble cellulose derivative in an organic solvent, applying the slurry on the surface of a mold-producing pattern, and then applying thereon a slurry having a powdered refractory substance mixed with a high-temperature binder, thereby forming a refractory slurry layer.

The mold produced by this method amply endures the molten metal pressure of an alloy being cast therein. It has $\alpha$-$Al_2O_3$ forming the entire cavity surface thereof. The $SiO_2$ which is produced from the high-temperature binder is not allowed to come into contact with the molten alloy.

This method nevertheless suffers from the following disadvantage.

In forming a face coat of the mold inactive to the melt of super alloy, this method uses an organic cellulose as a binding material. During the removal of the used pattern, which is generally effected by a treatment in an autoclave, there is the possibility that the face coat alone will be peeled off the mold.

The present invention has been produced for the purpose of overcoming this drawback.

SUMMARY OF THE INVENTION

To accomplish the object described above, the present invention provides a method for producing an investment shell mold by applying a refractory-containing slurry on the surface of a soluble or inflammable expendable pattern of a contour conforming exactly with the cavity of the mold thereby forming a refractory slurry layer thereon, solidifying the applied slurry layer, and thereafter removing the pattern, which method comprises first applying on the surface of the pattern the refractory-containing slurry obtained by adding a silicate binder to alumina powder and ceramic powder containing 0 to 85% by weight of at least one member selected from the group consisting of zircon ($ZrO_2.SiO_2$) powder, mullite ($3Al_2O_3.2SiO_2$) powder, and spinel ($MgO.Al_2O_3$) powder, then applying on the outer surface of the applied layer of the slurry a stucco material which is at least one member selected from the group consisting of alumina, double oxide of alumina, $ZrO_2$, and double oxide of $ZrO_2$, subsequently applying repeatedly the refractory-containing slurry and the stucco material alternately until the consequently formed layers assume a prescribed thickness, heating the applied layers at a temperature exceeding 1,400° C. thereby enabling the alumina powder to react with the silica produced from the binder and form mullite and allowing grains of the alumina and the double oxide thereof and the zirconia and the double oxide thereof to be dispersed in the matrix of the mullite thereby obtaining a mold of a texture inactive to the super alloy being cast.

BRIEF DESCRIPTION OF THE DRAWINGS

FIG. 1(*b*) is a schematic diagram illustrating in cross section a mold prepared similarly to the mold of FIG. 1(*a*) and fired at 1,500° C.

DESCRIPTION OF THE PREFERRED EMBODIMENT

Figure 1A:
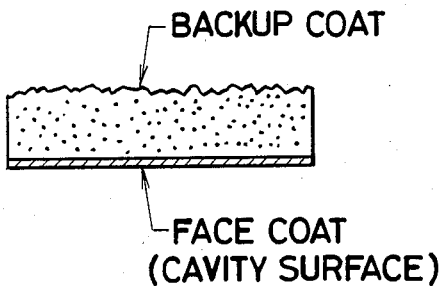
FIG. 1(*a*) is a schematic diagram illustrating in cross section a mold prepared by the method of this invention and fired at 800° C., a temperature falling outside the range of temperature defined for the method of this invention.
Figure 1B:
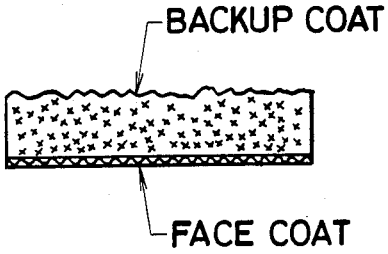

FIG. 1 shows explanatory schematic views illustrating in cross section investment shell molds produced by preparing a slurry having ethyl silicate hydrolyzate as a binder added to a refractory consisting of a mixture of zircon powder and aluminum powder, using alumina as a stucco material, and firing the formed layers of slurry and stucco material at 800° C. (outside the range of this invention) and 1500° C. (within the range of this invention), respectively, In FIG. 1(*a*) showing the mold fired at 800° C., free silica produced from the binder is present. The wall of the mold is formed of zircon, alumina, and amorphous silica throughout the entire thickness from the face coat constituting the cavity surface to the backup coat. In FIG. 1(*b*) showing the mold fired at 1,500° C., the alumina added to the zircon powder and the amorphous silica produced from the binder react with each other and form mullite which is stable at elevated temperatures. In this mold, no free silica is allowed to occur. Finally, the wall of the mold is formed of zircon, alumina, and mullite throughout the entire thickness. The diagrams show that the face coat alone is flat and smooth and the rest of the wall is formed of a uniform porous texture.

As the silicate binder to be added to the refractory in the present invention, the aforementioned ethyl silicate hydrolyzate or colloidal silica containing sodium and ammonium ion in minute amounts can be used.

The pattern on which the slurry is applied is destined to be removed from the layer of slurry after the slurry has hardened. It can be formed of wax as widely practised in the art.

The ceramic powder in the refractory-containing slurry is composed solely of alumina powder or of a mixture of alumina with the powder of zircon, mullite, or spinel. When the ceramic powder is formed of the mixture, the maximum content of the powders other than alumina in the total amount of the ceramic powder is 85% by weight. The mixture is desired to consist of 15 to 45% by weight of alumina and 55 to 85% by weight of the other ceramic powders. This is because the slurry is allowed to form mullite ($3Al_2O_3.2SiO_2$) by the firing at the elevated temperatures even when the binder to be used happens to have a different $SiO_2$ concentration.

Now, the present invention will be described more specifically below with reference to working examples and comparative experiments.

EXAMPLE 1 AND COMPARATIVE EXPERIMENT 1

An investment shell mold was produced by using zircon as a main refractory and ethyl silicate hydrolyzate as a binder.

| Slurry composition | |
|---|---|
| Zircon powder (10 to 20 μm in grain size) | 145 g |
| Alumina powder ($Al_2O_3$ of purity not less than 99.8%, 7~8 μm in grain size) | 45 g |
| Ethyl silicate hydrolyzate ($SiO_2$ content 16%) | 100 cc |

The concentration of the slurry for first application is generally desired to fall in the range of 20 to 30 seconds, preferably about 20 seconds, as measured with Zahn Cup No. 5. The concentrations of the slurries for second and subsequent application are desired to fall in the range of 10 to 25 seconds, preferably about 15 seconds, as measured with Zahn Cup No. 4.

As a stucco material alumina ($Al_2O_3$ of purity exceeding 99.8%) was used. The grain size of the stucco alumina for first application was in the range of 105 to 125 μm. The grain size for second and subsequent application was in the range of 177 to 210 μm.

The amount of the stucco material used generally falls in the range of 75 to 93% by weight, preferably about 85% by weight based on the total weight of the slurry.

Figure 3:
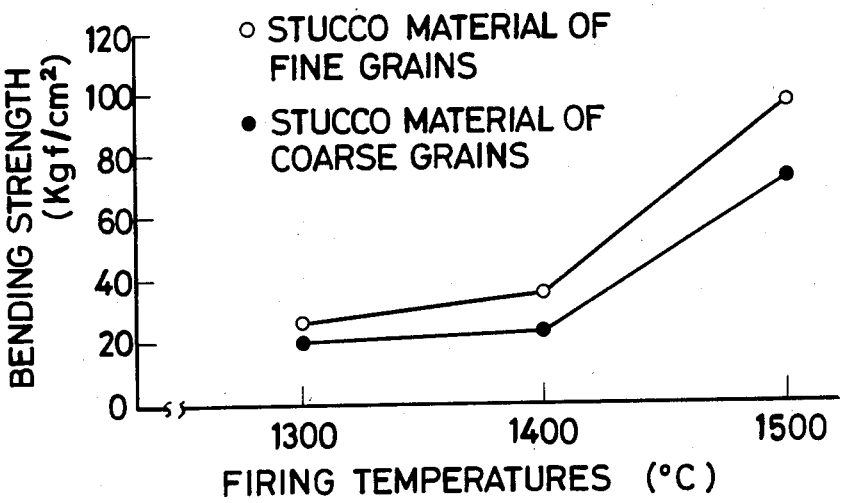
FIG. 3 is a graph showing the bending strength at 1,400° C. of molds produced by the method of this invention fired at different temperatures as indicated in Example 1.
Figure 2A:
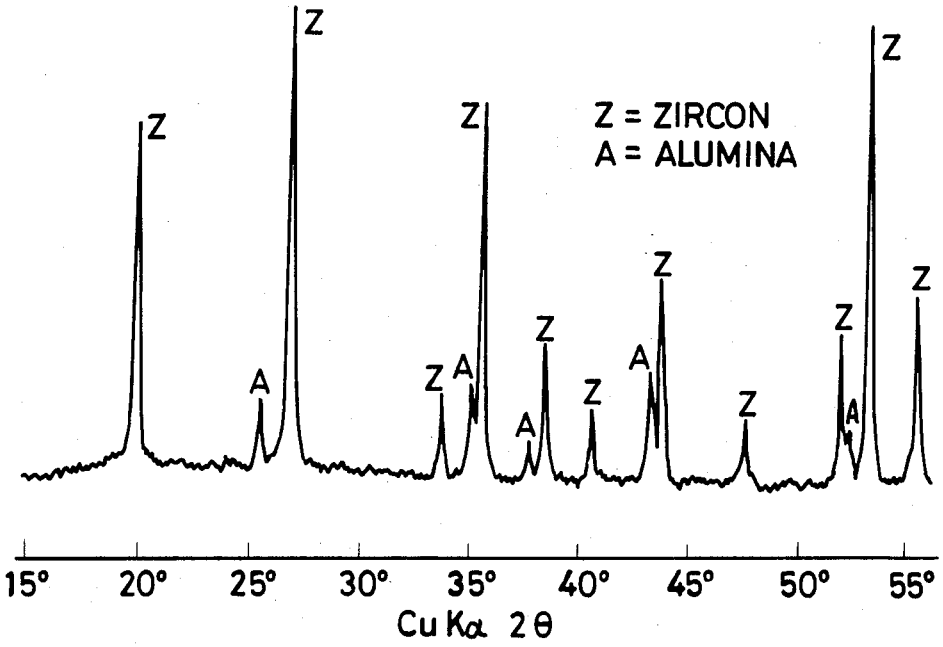
FIGS. 2(*a*) and (*b*) are X-ray diffraction diagrams of face coats formed on molds produced in Comparative Experiment 1 and Example 1.
Figure 2B:
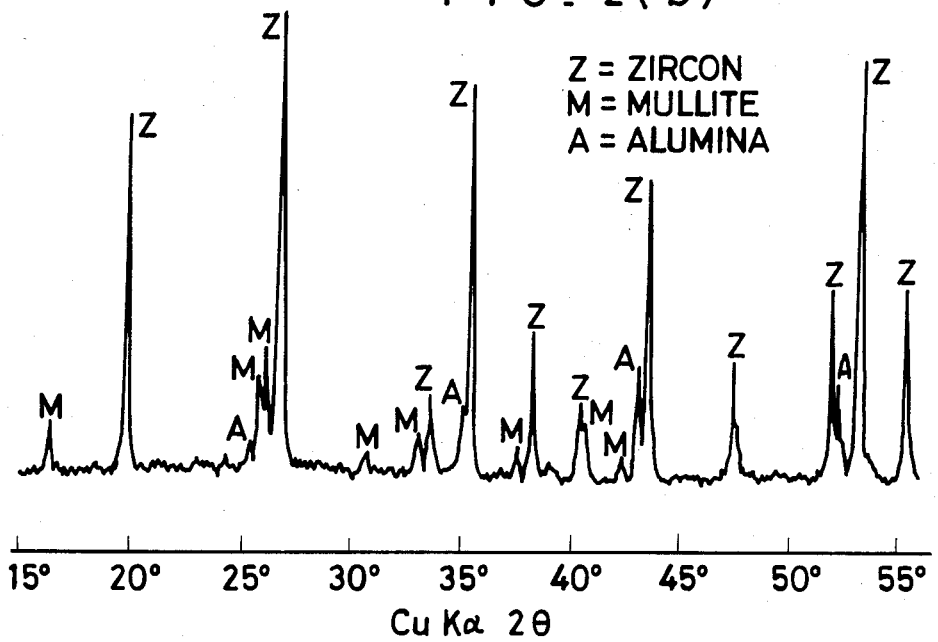

In the manner described above, the slurry and the stucco material were alternately applied repetitively on the surface of patterns until the applied layers of slurry and stucco material assumed a prescribed thickness. The layers so formed on one pattern were fired at 800° C. for two hours (Comparative Experiment 1). The layers on the other pattern were fired at 1,500° C. for one hour (Example 1). The X-ray diffraction diagrams of the face coats of the two molds consequently obtained are shown respectively in FIGS. 2(*a*) and (*b*). FIG. 2(*a*) shows a slight halo pattern with $2\theta=20°$ as the center, indicating the occurrence of amorphous silica. In FIG. 2(*b*), the halo pattern of FIG. 2(*a*) is no longer found and a peak evincing the formation of mullite is seen, indicating that free silica has wholly reacted with alumina to produce mullite. FIG. 3 shows data of bending strength at 1,400° C. obtained of molds produced by using stucco material of fine grains (177 to 210 μm) and coarse grains (297 to 350 μm) and firing temperatures of 1,300° C., 1,400° C., and 1,500° C. It is noted from the graph that the mold fired at 1,500° C. produced mullite and acquired a bending strength one step higher. In the mold obtained at this temperature, a Ni-base super alloy melt of the following composition was cast at 1,550° C. and subjected to grain-oriented casting under the conditions of a temperature gradient, G, of 60° C./cm and a solidification speed, R, of 10 cm/H.

Cr=10%, W=4.52%, Co=5.20%, Ta=11%, Ti=1.55%,
Al=5.12%, Si=0.01%, and Ni=Bal

The analysis of the cast alloy showed the following composition:

Cr=9.8%, W=4.53%, Co=5.22%, Ta=11%, Ti=1.55%,
Al=5.14%, Si=0.012%, and Ni=Bal

The loss of Cr was caused by vaporization during the steps of melting and solidification. The increase of Si was minimal. The cast product exhibited satisfactory high-temperature properties.

EXAMPLE 2 AND COMPARATIVE EXPERIMENT 2

An investment shell mold was produced by using, as a stucco material, alumina of the same grain size as in Example 1 and fixing the concentration of the slurry, which had the composition shown below, at the same level as in Example 1.

| Slurry composition | |
|---|---|
| Mullite ($3Al_2O_3.2SiO_2$) powder (10 to 20 μm in grain size) | 140 g |
| Alumina powder ($Al_2O_3$ of purity of not less than 99.8%, 7~8 μm in grain size) | 45 g |
| Ethyl silicate hydrolyzate ($SiO_2$ content 16%) | 100 cc |

Figure 4A:
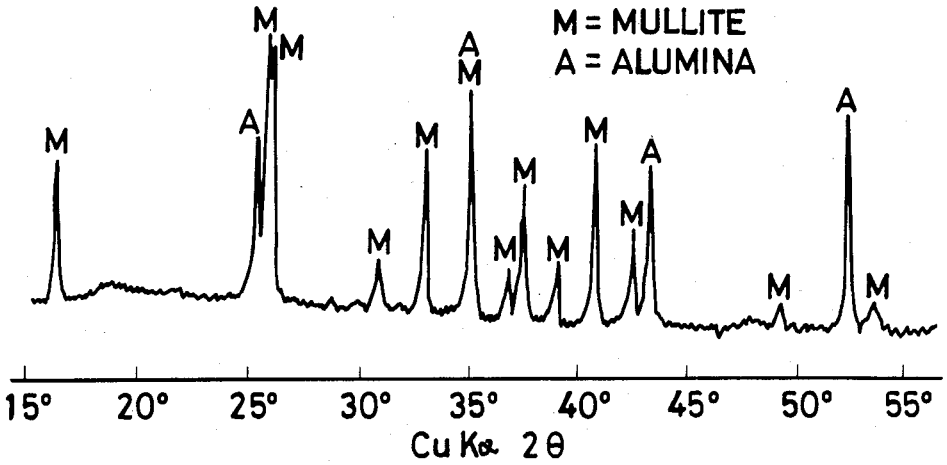
FIGS. 4(*a*) and (*b*) are X-ray diffraction diagrams of face coats formed on molds produce in comparative Experiment 2 and Example 2.
Figure 4B:
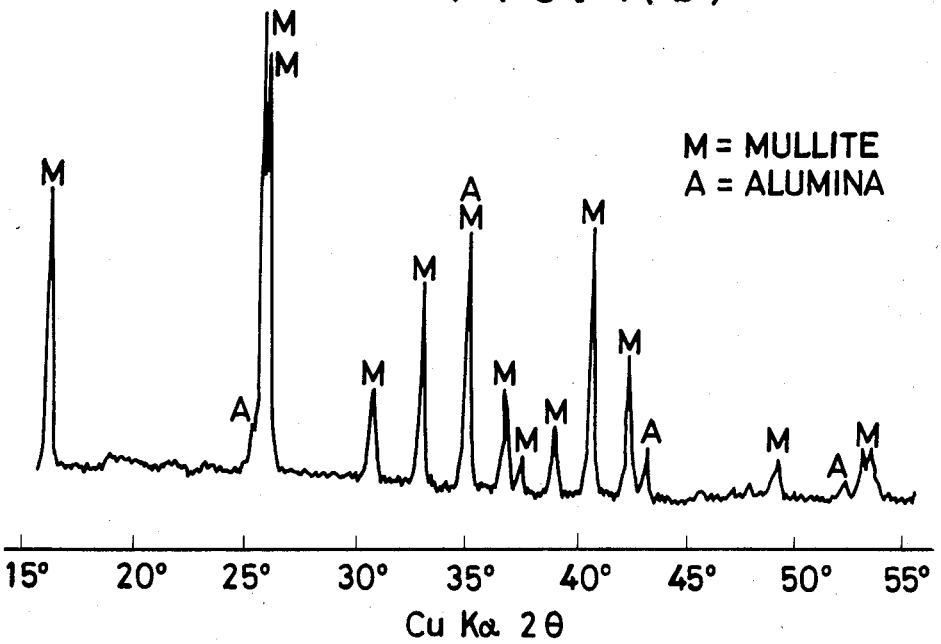

The X-ray diffraction diagrams obtained of the molds produced by firing at 800° C. (Comparative Experiment 2) and 1,500° C. (Example 2) are shown in FIGS. 4(*a*) and (b). FIG. 4 (*a*) shows a slight halo with $2\theta=20°$ as the center, indicating the occurrence of amorphous silica. In FIG. 4(*b*), the halo is no longer visible and the peak has a greater height, indicating that free silica reacted with alumina to produce mullite and the amount of mullite is consequently increased. In the investment shell mold of Example 2, a Ni-base super alloy melt of the same composition of the Example 1 was subjected to grain-oriented casting. The cast product, on analysis, was found to have an increase of 0.003% in the Si content. Thus, the investment shell mold produced as described above permitted fabrication of a grain-oriented cast product of Ni-base super alloy of high quality.

EXAMPLE 3

An investment shell mold was produced by using a slurry of the following composition, with mullite grains as a stucco material and with the grain size identical to that of the alumina grains of Example 1.

| Slurry composition | |
|---|---|
| Alumina powder (purity 99.9%, grain size 7~8 μm) | 190 g |
| Ethyl silicate hydrolyzate ($SiO_2$ content 16%) | 100 cc |

In this mold, the Ni-base super alloy melt of the aforementioned composition was cast. The cast product, on analysis, was found to have an increase of 0.002% in the Si content. This cast product exhibited satisfactory properties.

What is claimed is:

1. A method for producing an investment shell mold by applying a refractory-containing slurry onto the surface of a soluble or combustible expendable pattern of a contour conforming exactly to a cavity of the mold thereby forming a refractory slurry layer thereon, hardening the formed slurry layer, and thereafter removing the pattern, which method comprises first applying onto the surface of said pattern the refractory-containing slurry obtained by adding a silicate binder to ceramic powder comprising alumina powder and at least one member selected from the group consisting of zircon ($ZrO_2.SiO_2$) powder, mullite ($3Al_2O_3.2SiO_2$) powder, and spinel ($MgO.Al_2O_3$) powder, said ceramic powder containing said alumina powder in an amount of up to 85 parts by weight based on the total of said ceramic powder, then applying onto the outer surface of the applied layer of the slurry a stucco material which is at least one member selected from the group consiting of alumina, double oxide of alumina, $ZrO_2$, and double oxide of $ZrO_2$, subsequently applying repeatedly said refractory-containing slurry and said stucco material alternately until the consequently formed layers assume a prescribed thickness, and heating said formed layers to a temperature exceeding 1,400° C. thereby forming a layer stable relative to a melt of super alloy.

2. A method according to claim 1, wherein the ceramic powder in the refractory slurry consists of 15 to 45% by weight of alumina and 55 to 85% by weight of at least one member selected from the group consisting of zircon powder, mullite powder, and spinel powder.

* * * * *